US008966888B2

(12) United States Patent
Weaver et al.

(10) Patent No.: US 8,966,888 B2
(45) Date of Patent: Mar. 3, 2015

(54) SELF-CONTAINED MODULAR ACTUATOR

(76) Inventors: Jason C. Weaver, Austin, TX (US); Misty Whitcomb, Spicewood, TX (US); Clint Anderson, Spicewood, TX (US)

( * ) Notice: Subject to any disclaimer, the term of this patent is extended or adjusted under 35 U.S.C. 154(b) by 748 days.

(21) Appl. No.: 13/274,005

(22) Filed: Oct. 14, 2011

(65) Prior Publication Data

US 2012/0124987 A1 May 24, 2012

Related U.S. Application Data

(60) Provisional application No. 61/393,203, filed on Oct. 14, 2010.

(51) Int. Cl.

| | |
|---|---|
| ***F16D 31/02*** | (2006.01) |
| ***F04B 49/02*** | (2006.01) |
| ***A47K 13/10*** | (2006.01) |

(52) U.S. Cl.

CPC ..... *F04B 49/02* (2013.01); *A47K 13/10* (2013.01)

USPC ..... 60/409; 60/431

(58) Field of Classification Search

CPC ..... A47K 13/10

USPC ..... 4/246.2; 60/409, 431; 92/92, 91

See application file for complete search history.

(56) References Cited

U.S. PATENT DOCUMENTS

| | | | | |
|---|---|---|---|---|
| 1,051,508 | A | | 1/1913 | Miller |
| 2,842,779 | A | | 7/1958 | Zulkoski |
| 3,822,861 | A | | 7/1974 | Scott |
| 4,053,961 | A | | 10/1977 | Wilson et al. |
| 4,103,371 | A | | 8/1978 | Wilson |
| 4,169,353 | A | | 10/1979 | Fresard |
| 4,477,933 | A | | 10/1984 | Leckie |
| 4,577,350 | A | | 3/1986 | Clark |
| 4,849,742 | A | | 7/1989 | Warrington |
| 4,853,983 | A | | 8/1989 | Grant |
| 4,887,322 | A | | 12/1989 | Lydon |
| 4,951,325 | A | | 8/1990 | Tack |
| 5,029,347 | A | | 7/1991 | Lin |
| 5,058,216 | A | * | 10/1991 | Trayer et al. ..... 4/246.2 |
| 5,742,949 | A | | 4/1998 | Goldi et al. |
| 5,774,904 | A | | 7/1998 | McWilliams |
| 5,867,843 | A | | 2/1999 | Robello et al. |
| 5,878,444 | A | | 3/1999 | Convoy |
| 5,974,595 | A | | 11/1999 | McCabe |
| 6,138,289 | A | | 10/2000 | Sardo |
| 6,298,539 | B1 | | 10/2001 | Dissing |
| 6,321,393 | B1 | | 11/2001 | Jones |
| 6,321,394 | B1 | | 11/2001 | Steir et al. |
| 6,363,543 | B1 | | 4/2002 | Bright, Jr. |
| 6,523,185 | B1 | | 2/2003 | Moore et al. |
| 6,612,223 | B2 | | 9/2003 | Leonard et al. |
| 6,643,852 | B1 | | 11/2003 | Lin |
| 6,694,536 | B1 | | 2/2004 | Haygreen |
| 6,792,626 | B1 | | 9/2004 | Smeal et al. |
| 6,883,186 | B1 | | 4/2005 | Hernandez |
| 6,915,532 | B1 | | 7/2005 | Mohammed |
| 6,941,588 | B1 | | 9/2005 | Oprandi |
| 7,302,959 | B2 | * | 12/2007 | Gonia ..... 137/2 |
| 7,636,956 | B1 | | 12/2009 | Doucet |
| 2003/0154541 | A1 | | 8/2003 | Miller |
| 2009/0106885 | A1 | | 4/2009 | Sagre |

* cited by examiner

*Primary Examiner* — Edward Look
*Assistant Examiner* — Daniel Collins
(74) *Attorney, Agent, or Firm* — Norton Rose Fulbright US LLP

(57) ABSTRACT

Pneumatic actuator apparatuses with expandable chambers, and methods of using same. In some embodiments, the apparatuses are self-contained and/or self-inflating.

20 Claims, 6 Drawing Sheets

SELF-CONTAINED MODULAR ACTUATOR

CROSS-REFERENCE TO RELATED APPLICATIONS

This application claims priority to U.S. Provisional Patent Application No. 61/393,203, filed Oct. 14, 2010, which is incorporated here by reference in its entirety.

BACKGROUND

1. Field of the Invention

The present invention relates generally to actuators, and, more particularly, but not by way of limitation, to pneumatic actuators and methods of use.

2. Description of Related Art

A number of pneumatic actuators such as cylinders are known. Many are complex, expensive, and/or require external controllers and/or sources of compressed air.

SUMMARY

This disclosure includes embodiments of apparatuses (e.g., actuators), kits, and methods.

Some embodiments of the present apparatuses comprise: a housing; a cover configured to be coupled to the housing such that the housing and cover cooperate to define an expandable chamber; a pump coupled to the housing such that if the cover is coupled to the housing the pump is disposed in the chamber, and the pump is configured to pump air into the chamber to expand the volume of the chamber; a sensor; and a controller configured to activate the pump if the sensor detects an event.

In some embodiments, if the cover is coupled to the housing the controller is disposed in the chamber. In some embodiments, the controller is configured to activate the pump after a delay if the sensor detects an event. In some embodiments, the controller is configured to deactivate the pump if the sensor detects a second event. In some embodiments, the sensor comprises one or more sensors selected from the group consisting of: vibration sensors, sound sensors, motion sensors, infrared sensors, beam-trip sensors, sonar sensors, proximity sensors, and light sensors.

Some embodiments of the present apparatuses comprise: a housing; a cover configured to be coupled to the housing such that the housing and cover cooperate to define an expandable chamber; and a pump configured to pump air into the chamber to expand the volume of the chamber; a sensor coupled to the housing; and a controller configured activate the pump if the sensor detects vibrations; where the pump, sensor, and controller are configured to be coupled to a power source.

In some embodiments, the sensor is coupled to the housing such that if the cover is coupled to the housing the sensor is disposed in the chamber. In some embodiments, the pump is coupled to the housing such that if the cover is coupled to the housing the pump is disposed in the chamber. In some embodiments, the controller is configured to activate the pump after a delay if the sensor detects an event. In some embodiments, the controller is configured to deactivate the pump if the sensor detects a second event. In some embodiments, the sensor comprises one or more sensors selected from the group consisting of: vibration sensors, sound sensors, motion sensors, infrared sensors, beam-trip sensors, sonar sensors, proximity sensors, and light sensors.

In some embodiments, the cover comprises an elastic material. In some embodiments, the cover is removably coupled to the housing. In some embodiments, the apparatus is configured to be coupled to a power source outside the chamber. In some embodiments, the apparatus is configured to receive a power source in the chamber. In some embodiments, the power source comprises a battery. In some embodiments, the sensor is disposed in the chamber.

In some embodiments, the sensor is disposed outside the chamber. In some embodiments, the sensor is coupled to the housing. In some embodiments, the sensor is remote from the housing. In some embodiments, the pump comprises a compressor. In some embodiments, the pump comprises an inlet and an outlet, the outlet is in communication with the interior of the chamber, and the inlet is in communication with the outside of the chamber. In some embodiments, the apparatus further comprises: a tube in communication with the inlet of the pump and the outside of the chamber such that the pump can draw air into the chamber from outside the chamber. In some embodiments, the inlet of the pump is coupled to an inlet valve configured to substantially prevent air and fluid from entering the inlet of the pump if the pump is not activated. In some embodiments, the apparatus is configured such that if the cover is coupled to the housing, water is substantially prevented from entering the chamber if the pump is not activated. In some embodiments, the inlet valve is configured to permit at least air to enter the inlet of the pump if the inlet of the pump is activated.

In some embodiments, the controller is coupled to a printed circuit board (PCB). In some embodiments, the sensor is coupled to the PCB board.

Some embodiments further comprise: a valve configured to be actuated to decrease the amount of air in the chamber. In some embodiments, the apparatus is configured such that if the volume of the chamber is expanded relative to a minimum chamber volume, decreasing the amount of air in the chamber will decrease the volume of the chamber. In some embodiments, the valve is coupled to the controller and is configured such that the controller can actuate the valve. In some embodiments, the valve is configured such that once opened, the valve will remain open for at least a predetermined period of time. In some embodiments, the apparatus is configured such that once opened, the valve will remain open for at least a predetermined period of time, unless the sensor detects a second event. In some embodiments, the valve is configured such that if the pressure in the chamber exceeds an upper threshold pressure of the valve, the valve will open to release air from the chamber. In some embodiments, the apparatus is configured such that if opened the valve will remain open until the pressure in the chamber falls below a lower threshold pressure of the valve. In some embodiments, the apparatus is configured such that if the cover is coupled to the housing, water is substantially prevented from entering the chamber if (i) the pump is not activated, and (ii) the pressure in the chamber is below the lower threshold pressure of the valve.

In some embodiments, the apparatus is configured such that if the cover is coupled to the housing, water is substantially prevented from entering the chamber if (i) the pump is not activated, and (ii) the volume of the chamber is at a minimum chamber volume.

In some embodiments, the housing includes a first side and a second side, the first side is configured to be coupled to a front surface of a toilet tank, and the chamber is configured to expand in a direction extending from the first side of the housing through the second side.

In some embodiments, the housing includes a first side and a second side, the first side is configured to be coupled to a lower surface of a toilet lid, and the chamber is configured to expand in a direction extending from the first side of the housing through the second side.

Some embodiments further comprise: a connector coupled to the first side of the housing. In some embodiments, the connector comprises one or more connectors selected from the group consisting of: double-sided tape, hook-and-loop fastener, magnet, suction cups, adhesive, glue, epoxy, and caulk.

Some embodiments of the present kits comprise: any of the present apparatuses; and one or more additional covers configured to be coupled to the housing; where the cover and the one or more additional covers can be removably and interchangeably coupled to the housing. Some embodiments further comprise: one or more batteries couplable to the apparatus such that the batteries can power the apparatus.

Some embodiments of the present kits comprise: any of the present apparatuses; and one or more resilient cushions configured to be coupled to an upper surface of a toilet bowl or a lower surface of a toilet seat of a toilet having a toilet seat such that if the toilet seat is in a lowered position, the one or more resilient cushions are disposed between the toilet seat and the upper surface of the toilet bowl. In some embodiments, each of the one or more resilient cushions includes a first side and a second side, and comprises double-sided tape coupled to the first side.

In some embodiments of the present methods of coupling an apparatus to a toilet having a toilet tank and a toilet seat, the method comprises: coupling any of the present apparatuses to a front surface of the toilet tank such that if the toilet seat is in a raised position, the pump can be activated to expand the volume of the chamber sufficiently to cause the cover to move the toilet seat to a lowered position.

In some embodiments of the present methods of coupling an apparatus to a toilet having a toilet tank, a toilet seat, and a toilet lid, the method comprises: coupling any of the present apparatuses to a lower surface of the toilet lid such that if the toilet seat and toilet lid are in a raised position, the pump can be activated to expand the volume of the chamber sufficiently to cause the cover to move the toilet seat to a lowered position.

Some embodiments of the present methods further comprise; activating the pump to expand the volume of the chamber sufficiently to cause the cover to move the toilet seat to the lowered position. Some embodiments further comprise; coupling one or more resilient cushions to an upper surface of a toilet bowl or a lower surface of a toilet seat.

Any embodiment of any of the present devices and kits can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

Details associated with the embodiments described above and others are presented below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DESCRIPTION OF ILLUSTRATIVE EMBODIMENTS

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a device or kit that "comprises," "has," "includes" or "contains" one or more elements possesses those one or more elements, but is not limited to possessing only those elements. Likewise, a method that "comprises," "has," "includes" or "contains" one or more steps possesses those one or more steps, but is not limited to possessing only those one or more steps.

Further, a device, system, or structure that is configured in a certain way is configured in at least that way, but it can also be configured in other ways than those specifically described.

Figure 1:
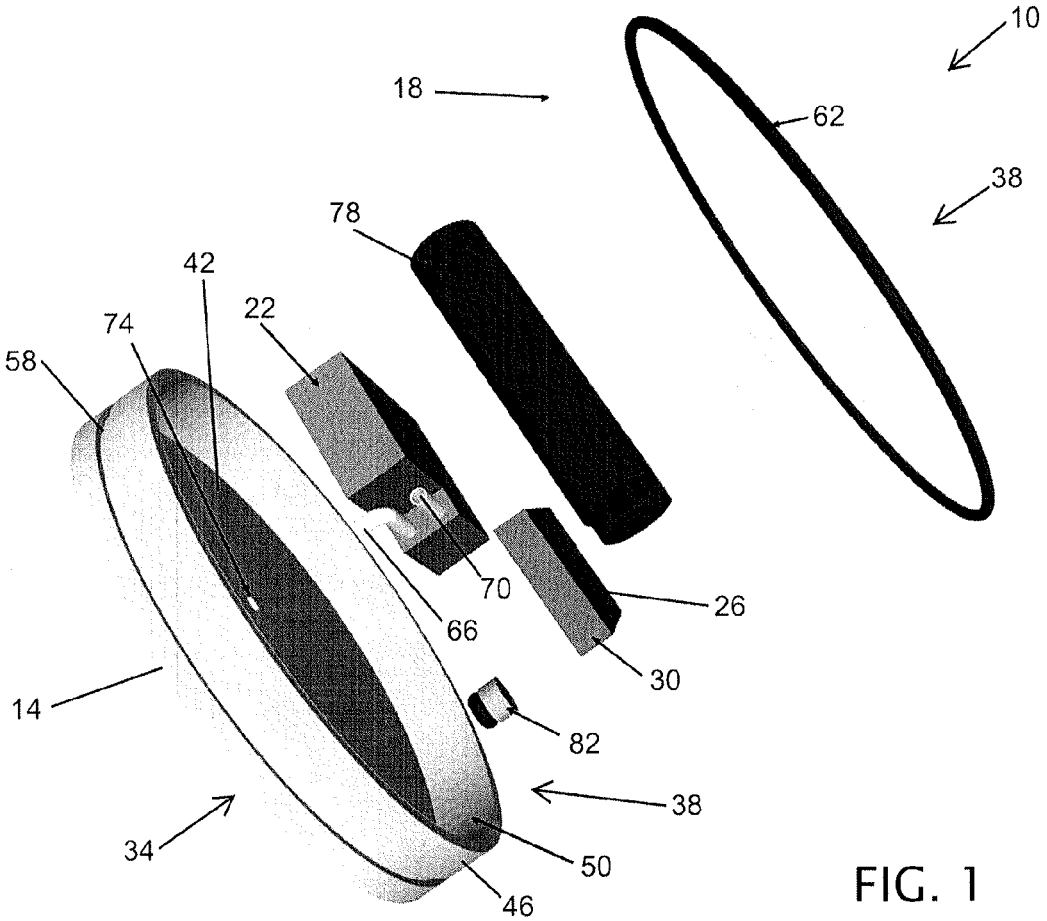
FIG. 1 depicts an exploded perspective view of one embodiment of the present apparatuses.
Figure 2:
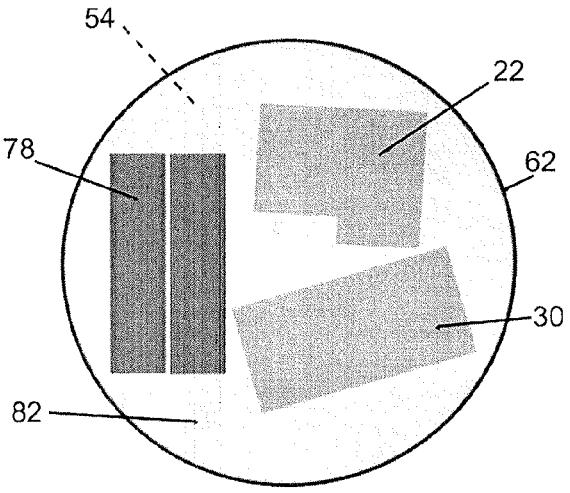
FIG. 2 depicts a top view of the apparatus of FIG. 1.
Figure 3:
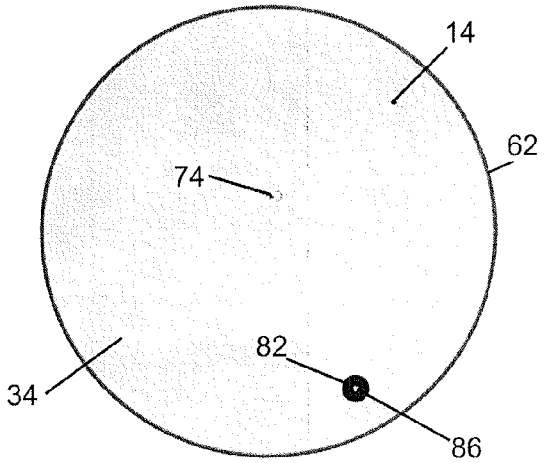
FIG. 3 depicts a bottom view of the apparatus of FIG. 1.

Referring now to the drawings, and more particularly to FIGS. 1-3, shown therein and designated by the numeral 10 is one embodiment of the present apparatuses. FIG. 1 illustrates an exploded perspective view of apparatus 10; FIG. 2 illustrates a top view of apparatus 10; and FIG. 3 illustrates a bottom view of apparatus 10. In the embodiment shown, apparatus 10 can be described as an actuator, as will be described in more detail below.

In the embodiment shown, apparatus 10 comprises: a housing 14, a cover 18, a pump 22, a sensor 26, and a controller 30. In the embodiment shown, housing 14 has a first side 34 and a second side 38, and includes a bottom wall 42 and a sidewall 46 that defines a cavity 50. Housing 14 can comprise a substantially rigid material, such as, for example, plastic, polymer, metal (e.g., stainless steel, aluminum, etc.), polycarbonate (PC), acrylonitrile butadiene styrene (ABS), PC/ABS blend, polypropylene (PP), any combination thereof, and/or other materials that permit the apparatus to function as described in this disclosure. In other embodiments, housing 14 may comprise a partially flexible material. As shown, cover 18 is configured to be coupled to housing 14 such that housing 14 and cover 18 cooperate to define an expandable chamber 54 (between housing 14 and cover 18 such that chamber 54 partially includes cavity 50). Cover 18 comprises a flexible (e.g., elastic and/or resilient) material such that when coupled to housing 14 to define chamber 54, chamber 54 can be filled with air or the like to expand cover 18 and thereby expand chamber 54 (the volume of chamber 54). Cover 18 can comprise, for example, rubber (e.g., natural rubber, nitrile rubber, synthetic rubber, etc.), latex (e.g., synthetic latex, natural latex, etc.), polyvinyl chloride (PVC), styrenic elastomers, polyurethanes, silicones, aromatic polyurethanes, aliphatic polyurethanes, and/or the like. In the embodiment shown, cover 18 is configured to be removably coupled to housing 14. More particularly, in the embodiment shown, housing 14 includes a peripheral groove 58 such that cover 18 can be placed over housing 14 and an O-ring (or other elastic band) 62 can be disposed around cover 18 in alignment with groove 58. In this way, O-ring 62 can draw cover 18 into groove 58 to retain the cover 18 relative to housing 14 sufficiently to permit operation of apparatus 10, as described in this disclosure. In other embodiments, cover 18 can be coupled to housing 14 in any way that permits chamber 54 to be inflated as described in this disclosure. Additional examples of ways of coupling cover 18 and housing 14 are described below with reference to FIGS. 7-16.

In the embodiment shown, pump (or compressor) 22 is coupled to housing 14 such that if cover 18 is coupled to housing 14, pump 22 is disposed in chamber 54, and pump 22 is configured to pump air into chamber 54 to expand the volume of the chamber. In other embodiments, pump 22 can be disposed outside chamber 54 (e.g., can be coupled to an external surface of housing 14, such as, for example, at first side 34). In the embodiment shown, pump 22 includes an inlet 66 in communication with the exterior of chamber 54, and an outlet 70 in communication with the interior of chamber 54. In the embodiment shown, inlet 66 is coupled (e.g., via a tube, as shown)) to an intake hole 74 that extends through housing 14 (e.g., through bottom wall 42, as shown) such that pump 22 can draw air from outside chamber 54 through hole 74 and inlet 66, through pump 22, and into chamber 54 through outlet 70. Examples of pumps that are suitable for some embodiments of the present apparatuses include: the CMP-11 and CMP-17 series of compressors, manufactured by Alldoo Micropump Co, Ltd. (China); and the Model V200 pump, manufactured by Xavitech AB (Sweden)); and the KPM08A pump, manufactured by Koge Electronics Co., Ltd. (China).

In some embodiments, apparatus 10 can be configured such that if cover 18 is coupled to housing 14, water is substantially prevented from entering chamber 54 if the pump is not activated. In some embodiments, the construction or configuration of pump 22 is sufficient to prevent water from passing through pump 22 and into chamber 54 when the pump is inactive. In some embodiments, inlet 66 of pump 22 is coupled to an inlet valve (not shown, but, for example, between the tube and intake hole 74) configured to substantially prevent air and fluid from entering inlet 66 if pump 22 is not activated (e.g., an inlet valve that remains closed when pump 22 is not in use). In some embodiments, the inlet valve can be configured to permit at least air to enter inlet 66 if the pump is activated. For example, the inlet valve can be electronically actuated by controller 30, or can be biased to a closed position in such a way that the valve is mechanically opened by the application of suction from the pump when the pump is activated.

In the embodiment shown, sensor 26 is disposed on an external surface of controller 30. In other embodiments, sensor 26 can be disposed on a common printed circuit board (PCB) (to which both sensor 26 and controller 30 are coupled), can be coupled or connected elsewhere to housing 14 (e.g., inside or outside chamber 54 such that sensor 26 is not remote from housing 14), or can be remote from housing 14 (e.g., coupled to controller by a wire or a wireless connection). Sensor 26 is configured to detect one or more events, such as, for example, a person entering a room or entering or leaving a predetermined proximity of the apparatus, an object entering or leaving a predetermined proximity of the apparatus, a light being switched on, a sound or vibration, or the like. Sensor 26 can, for example, comprise one or more sensors of: vibration sensors, sound sensors, motion sensors, infrared sensors, beam-trip (e.g., laser) sensors, sonar sensors, pressure sensors, proximity sensors, and/or light sensors.

Examples of sound sensors that are suitable for some embodiments of the present apparatuses include: the model MD9745APZ-F electric condenser microphone, manufactured by Knowles Acoustics (USA); and the model ADMP401 omnidirectional MEMS microphone, manufactured by Analog Devices, Inc. (USA). Examples of an infrared sensors that are suitable for some embodiments of the present apparatuses include the MLX90614 series infrared thermometers, manufactured by Melexis Microelectronic Systems (Belgium). Examples of light sensors that are suitable for some embodiments of the present apparatuses include: the model TSL235R light detector, manufactured by TAOS, Inc. (USA); and the model GL5528 photocell (CdS photoconductive cell), manufactured by Lida Optical and Electronic Co., Ltd. (China). Examples of vibrations sensors that are suitable for some embodiments of the present apparatuses include the model MiniSense 100 vibration sensor, manufactured by Measurement Specialties (USA). Examples of motion sensors that are suitable for some embodiments of the present apparatuses include: the model SE-10 motion sensor, manufactured by Hanse Electronic Co., Ltd. (South Korea). Examples of sonar sensors that are suitable for some embodiments of the present apparatuses include the model LV-MaxSonar-E70 ultrasonic rangefinder, manufactured by MaxBotix, Inc. (USA). Examples of pressure sensors that are suitable for some embodiments of the present apparatuses include the model A201 Flexiforce Pressure Sensor manufactured by Tekscan, Inc (USA). Examples of optical proximity sensors that are suitable for some embodiments of the present apparatuses include the model HSDL-9100 surface-mount reflective proximity sensor (with infrared LED emitter and photodiode) available from Avago Technologies, Inc. (USA).

In the embodiment shown, controller 30 is also coupled to housing 14 and disposed within chamber 54. In other embodiments, controller 30 can be disposed outside chamber 54 (e.g., coupled to housing 14) and/or can be remote from housing 14. Controller 30 is configured to communicate with pump 22 and sensor 26, and controller 30 is further configured to activate pump 22 if sensor 26 detects an event. In some embodiments, controller 30 is configured to activate pump 22 after a delay (after the event), such as, for example, after a delay that is equal to, greater than, or between, any of: 10 seconds, 20 seconds, 30 seconds, 40 seconds, 50 seconds, 1 minute, 2 minutes, 3 minutes, 4 minutes, 5 minutes, or more. For example, if sensor 26 comprises a pressure sensor within chamber 54, and sensor 26 detects an increase or spike in pressure within chamber 54 (e.g., from something contacting or impacting cover 18), controller 30 can signal or otherwise activate pump 22 to begin pumping air into chamber 54 after the predetermined delay (e.g., 1 minute).

In some embodiments, controller 30 is configured to activate pump 22 for a predetermined period of time, such as, for example, a period of time that is equal to, greater than, or between, any of: 10 seconds, 20 seconds, 30 seconds, 40 seconds, 50 seconds, 1 minute, 2 minutes, 3 minutes, 4 minutes, 5 minutes, or more. In other embodiments, controller 30 is configured to activate pump until a predetermined condition is achieved. For example, when sensor 26 comprises a pressure sensor, controller 30 can be configured to activate pump 22 until the pressure within chamber 54 reaches a predetermined threshold level (e.g., 1, 2, 3, 4, 5, 6, 7, 8, 9, 10, or more pounds per square inch (PSI)).

In some embodiments, controller 30 is configured to not activate pump 22 if sensor 26 detects a second event (e.g., a second event that negates the need to respond to the first detected event), such as, for example, a second event within the period of delay that precedes pump activation, or within the period of pump activation. For example, if sensor 26 detects a second event that includes a decrease in pressure (e.g., that negates the increase or spike in pressure detected for the first event), controller 30 can be configured to reset or otherwise return to a state in which controller 30 will not activate pump 22 until detecting another event. Controller 30 can include any suitable programmable logic device, such as, for example, CPUs, field-processing gate arrays (FPGAs), and/or the like. Examples of controllers that are suitable for some embodiments of the present embodiments include: PIC18 and PIC32 Series 8- and 32-bit microcontrollers, manufactured by Microchip Technology Inc. (USA); and AVR Series B- and 32-bit microcontrollers, manufactured by Amtel Corporation (USA).

In the embodiment shown, pump 22, sensor 26, and controller 30 are configured to be coupled to a power source 78 (e.g., one or more batteries 78). In the embodiment shown, apparatus 10 is configured to receive power source 78 within chamber 54. In other embodiments, power source 78 can be disposed outside chamber 54 (e.g., coupled to housing 14) and/or remote from housing 14.

Apparatus 10 can be described as having a minimum chamber volume 54 in which cover 18 is in a relaxed state (e.g., air within chamber 54 is at ambient pressure). In some embodiments (e.g., embodiments in which cover 18 is elastic), apparatus 10 can be configured such that if the volume of the chamber is expanded relative to a minimum chamber volume, decreasing the amount of air in the chamber will decrease the volume of the chamber. In some embodiments, pump 22 is configured such that if the pump 22 is deactivated or shut off, air can slowly escape chamber 54 through the pump an intake hole 74.

In the embodiment shown, apparatus 10 comprises a valve 82 configured to be actuated to isolate or close chamber 54, and/or to decrease the amount of air in chamber 54 (e.g., to reduce the volume of chamber 54), such as, for example, after pump 22 has been activated to increase the volume of chamber 54. In the embodiment shown, housing 14 includes an exhaust hole 86, and valve 82 is coupled to hole 86 such that when valve 82 is opened, air is permitted to pass out of chamber 54 through valve 82 and hole 86. Controller 30 can be coupled or otherwise configured to communicate with valve 82, such that if pump 22 is de-activated or shut off, controller 30 can cause valve 82 (e.g., via a signal or the like) to open to permit air to escape chamber 54. In some embodiments, valve 82 is configured to open if the pressure in chamber exceeds a threshold pressure (e.g., 1, 2, 3, 4, 5, 6, 7, 8, 9, 10, or more PSI), and/or valve 82 is configured such that if opened the valve will remain open until the pressure in chamber 54 falls below a lower threshold pressure of the valve (e.g., ambient pressure or slightly above ambient pressure). In such embodiments, controller 30 can be configured to activate pump 22 for a period of time sufficient to exceed the threshold pressure, such that valve 82 will open shortly before, simultaneously with, or slightly after pump 22 shuts off, such that the chamber 54 deflates to a pressure that is equal to or slightly above (e.g., 1, 2, 3, 4, 5, 6, 7, 8, 9, 10 or more percent above) ambient pressure. In such embodiments, valve 82 will remain closed when chamber 54 is at the minimum chamber volume, and apparatus 10 can be configured such that if cover 18 is coupled to housing 14, water is substantially prevented from entering chamber 54 if (i) pump 22 is not activated, and (ii) the volume of chamber 54 is at a minimum chamber volume (and/or below the lower threshold pressure of valve 82). Some embodiments of the present apparatuses do not include valve 82. Examples of electronically-actuated valves that are suitable for some embodiments of the present apparatuses include models KSV2WA-12I and KSV15C valves, manufactured by Koge Electronics Co., Ltd. (China).

In some embodiments, controller 30 is configured to deactivate pump 22 and/or open valve 82 if sensor 26 detects a second event, (e.g., within a predetermined period of time from the first event, such as, for example, 0.25, 0.5, 0.75, 1, 2, 3, 4, and/or 5 minutes) such as, for example, a pressure change in chamber 54 (e.g., due to toilet seat contacting or losing contact with cover 18, such as if the toilet seat falls to a closed or lowered position, or is lifted from a lowered position, respectively), detecting a person reentering the room, detecting a person entering a predetermined proximity of the apparatus, an object extending between the toilet bowl and the toilet seat (e.g., a child's arm extending over the toilet bowl while the toilet seat is in a raised position), detecting the motion of the seat being raised to an upper position.

In some embodiments, apparatus 10 further comprises a connector (not shown) coupled to first side 34 of housing 14. The connector can comprise, for example, one or more of double-sided tape, hook-and-loop fastener (Velcro), magnet, suction cups, and/or adhesive.

In some embodiments, apparatus 10 is configured such that when in its resting or deflated state, apparatus 10 can fit within a rectangular volume having maximum dimensions of 3 inches by 3 inches by 1.25 inches. In other embodiments, apparatus 10 is configured such that when in its resting or deflated state, apparatus 10 can fit within a rectangular volume having maximum dimensions of 2-5 inches (e.g., equal to, greater than, or between any of: 2, 2.5, 3, 3.5, 4, 4.5, and/or 5 inches) by 2-5 inches (e.g., equal to, greater than, or between any of: 2, 2.5, 3, 3.5, 4, 4.5, and/or 5 inches) by 1-3 inches (e.g., equal to, greater than, or between any of: 1, 1.5, 2, 2.5, and/or 3 inches). In other embodiments, apparatus 10 is configured such that when in its activated or inflated state, apparatus 10 can fit within a rectangular volume having maximum dimensions of 2-5 inches (e.g., equal to, greater than, or between any of: 2, 2.5, 3, 3.5, 4, 4.5, and/or 5 inches) by 2-5 inches (e.g., equal to, greater than, or between any of: 2, 2.5, 3, 3.5, 4, 4.5, and/or 5 inches) by 1.5-8 inches (e.g., equal to, greater than, or between any of: 1.5, 2, 2.5, 3, 3.5, 4, 4.5, 5, 5.5, 6, 6.5, 7, 7.5, and/or 8 inches).

Figure 4:
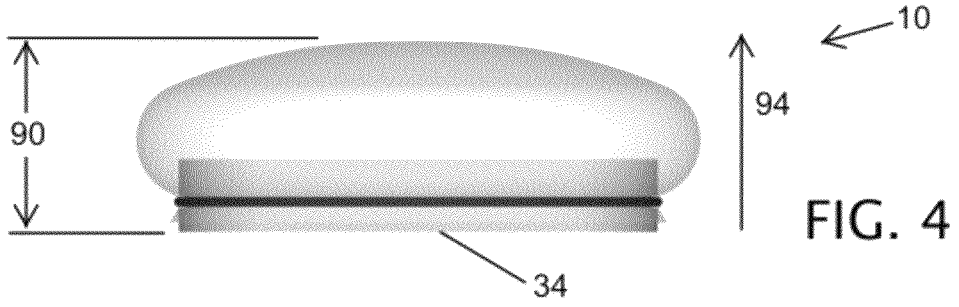
FIGS. 4 and 5 depict side views of the apparatus of FIG. 1 in different states of inflation.
Figure 5:
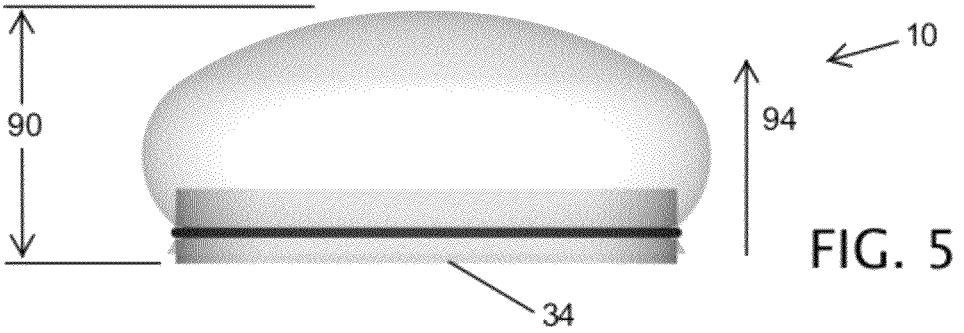

FIGS. 4 and 5 illustrate the operation of apparatus 10. In its initial state prior to use, chamber 54 is at the minimum chamber volume in which chamber 54 is at ambient pressure. Once pump 22 is activated, the volume in chamber 54 increases and cover 18 begins expand, as shown in FIG. 4, increasing thickness 90 of apparatus 10. At the time pump 22 is deactivated or shut off, chamber 54 is at a maximum chamber volume and maximum thickness 90, as shown in FIG. 5. The difference in thickness 90 as chamber 54 inflates permits apparatus 10 (cover 18) to impart a mechanical force in direction 94 that extends from first side 34 through second side 38.

Figure 6:
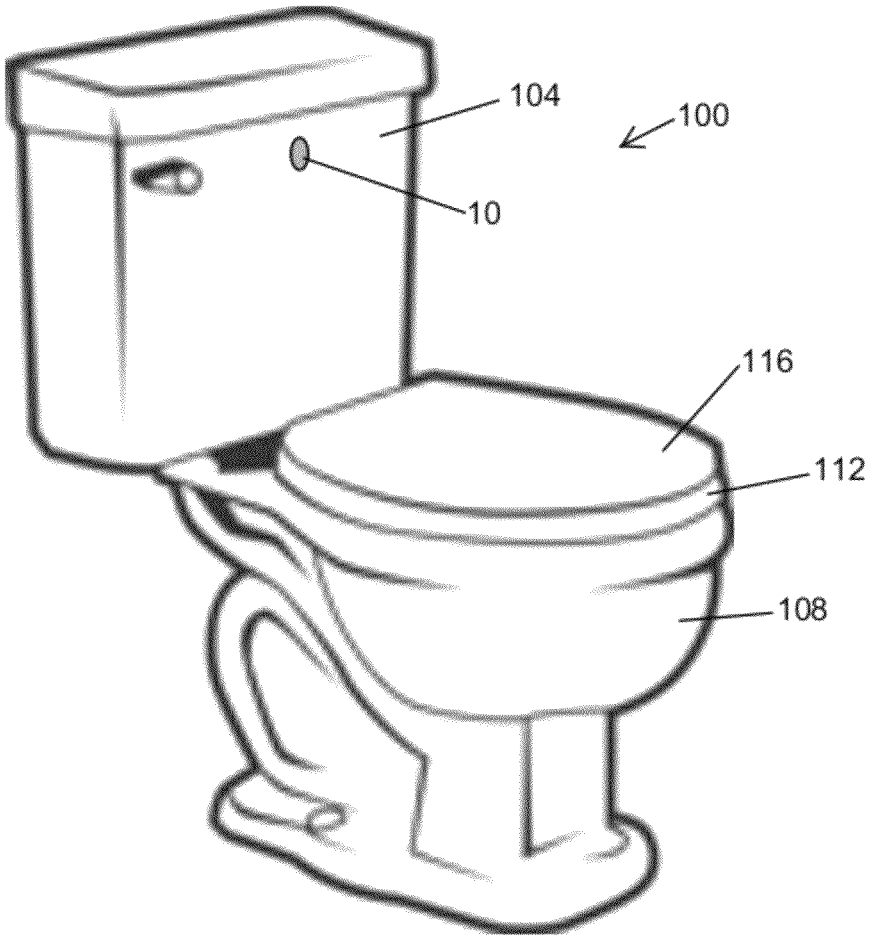
FIG. 6 depicts one way of using some embodiments of the present apparatuses to automatically close a toilet seat after use.

FIG. 6 illustrates one example of a use for the present apparatuses with a toilet 100. In the embodiment shown, toilet 100 includes a toilet tank 104, a toilet bowl 108, a toilet seat 112, and a toilet lid 116. In some embodiments, housing 14 (e.g., first side 34) of apparatus 10 can be configured to be coupled to a front surface of a toilet tank (e.g., 104) such that chamber 54 can expand in a direction (e.g., 94) extending from first side 34 of housing 14 through second side 38, such that, for example, chamber 54 (and cover 18) can expand to tip the toilet lid 116 and toilet seat 112 from an open position to a closed position. In some embodiments, housing 14 (e.g., first side 34) of apparatus 10 can be configured to be coupled to a lower surface of a toilet lid (e.g., 116) such that chamber 54 can expand in a direction (e.g., 94) extending from first side 34 of housing 14 through second side 38, such that, for example, chamber 54 (and cover 18) can expand to tip the toilet seat 112 from an open position to a closed position (e.g., while permitting toilet lid 116 to remain in an open position).

Some embodiments of the present methods comprise: coupling an embodiment of the present apparatuses (e.g., 10) to a front surface of a toilet tank such that if the toilet seat is in a raised position, the pump can be activated to expand the volume of chamber 54 sufficiently to cause the cover to move the toilet seat to a lowered position (e.g., to tilt the toilet seat to an angle, such as less than 90 degrees from the top of the toilet bowl, at which gravity will pull the toilet seat down to a lowered position). Some embodiments of the present methods comprise: coupling an embodiment of the present apparatuses (e.g., 10) to a lower surface of the toilet lid such that if the toilet seat and toilet lid are in a raised position, the pump can be activated to expand the volume of the chamber sufficiently to cause the cover to move the toilet seat to a lowered position. Some embodiments of the present methods comprise: activating the pump of the apparatus to expand the volume of the chamber sufficiently to cause the cover to move the toilet seat to the lowered position. Some embodiments of the present methods further comprise: coupling one or more resilient cushions (not shown) to an upper surface of the toilet bowl or coupling one or more resilient cushions to the lower surface of seat 112 (such that if the toilet seat is closed, the one or more cushions will be disposed between the top surface of the toilet bowl and the toilet seat). Such cushions can comprise one or more of: foam, memory foam, rubber, foam rubber, or the like.

Some embodiments of the present kits comprise an embodiment of the present apparatuses (e.g., 10), and one or more additional covers (e.g., 18) configured to be coupled to housing 14; where cover 18 and the one or more additional covers can be removably and interchangeably coupled to the housing. Some embodiments of the present kits further comprise one or more batteries (e.g., couplable to the apparatus such that the batteries can power the apparatus).

Some embodiments of the present kits comprise an embodiment of the present apparatuses (e.g., 10), and one or more resilient cushions (not shown) configured to be coupled to an upper surface of a toilet bowl of a toilet having a toilet seat, and/or coupled to the lower surface of a toilet seat, such that if the toilet seat is in a lowered position, the one or more resilient cushions are disposed between the toilet seat and the upper surface of the toilet bowl. In some embodiments, each of the one or more resilient cushions includes a first side and a second side, and comprises double-sided tape coupled to the first side.

Figure 7:
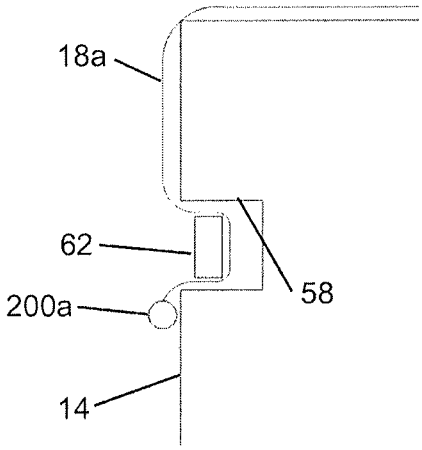
FIGS. 7-16 depict alternate configurations for coupling a cover to a housing of the present apparatuses.

FIGS. 7-16 depict alternative configurations for coupling the cover (18) to the housing (14). The various alternatives of FIGS. 7-16 are similar in some respects to the configuration of apparatus 10, and to each other. As such, the following description primarily focuses on the differences between the various configurations. FIG. 7 depicts a configuration in which an alternate embodiment 18*a* of the cover includes an enlarged peripheral bead 200*a*. Bead 200*a* can be of unitary construction with the cover (e.g., an enlarged portion of a continuous piece of material) or can be a separate piece of material that is attached to the cover (e.g., by wrapping the cover membrane around bead 200*a*). In other embodiments, bead 200*a* may be omitted.

Figure 8:
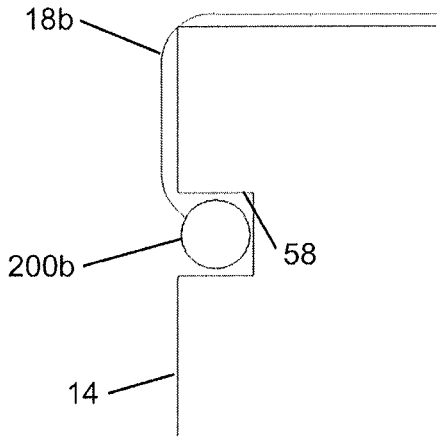

FIG. 8 depicts an alternate configuration in which an enlarged bead 200*b* is received in groove 58 instead of O-ring 62. As shown, cover 18*b* is slightly smaller such that bead 200*b* aligns with groove 58. As with bead 200*a*, bead 200*b* can be of unitary construction with the cover (e.g., an enlarged portion of a continuous piece of material) or can be a separate piece of material that is attached to the cover (e.g., by wrapping the cover membrane around bead 200*b*). In some embodiments, bead 200*b* and/or cover 18*b* comprise an elastic and/or resilient material; and/or bead 200*b* has an overall circumference or perimeter that is smaller than the outermost circumference or perimeter of housing 14 (e.g., less than the smallest circumference in groove 58) such that bead 200*b* must be stretched or expanded to be disposed in groove 58 and will contract into groove 58 to resist removal of cover 18*b* from housing 14.

Figure 9:
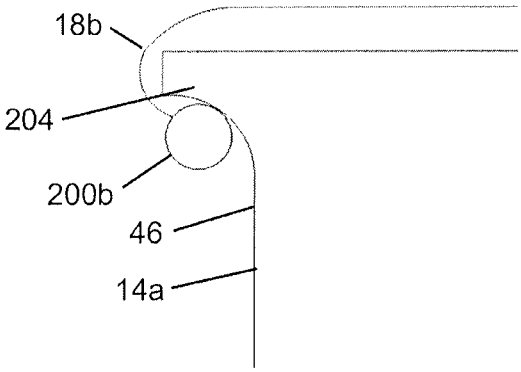

FIG. 9 depicts an alternative configuration in which housing 14*a* includes a lateral protrusion 204 around the upper perimeter of sidewall 46, and does not include groove 58. In this configuration, bead 200*b* cooperates with protrusion 204 and/or the remainder of sidewall 46 to couple cover 18*b* to housing 14*a*.

Figure 10:
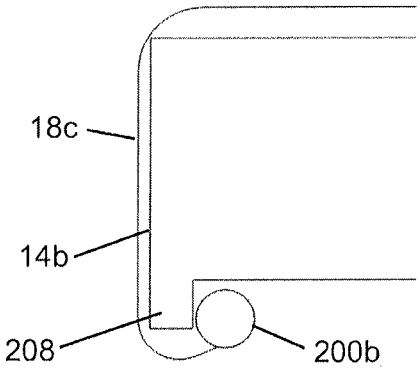

FIG. 10 depicts an another configuration in which housing 14*b* includes a vertical protrusion 208 extending from first side 34 around the lower perimeter of first side 34. Cover 18*c* is slightly larger to permit bead 200*b* to extend around protrusion 208, as shown, such that bead 200*b* cooperates with protrusion 208 and/or the remainder of the bottom of housing 14*b* to coupled cover 18*c* to housing 14*b*. In some embodiments, bead 200*b* has an overall perimeter or circumference that is less than the outermost circumference or perimeter of protrusion 208 (e.g., less than the inner circumference of protrusion 208) such that bead 200*b* must be stretched or expanded to be placed inside protrusion 208 (such that cover 18*c* extends around protrusion 208), as shown, and will contract to resist removal of cover 18*c* from housing 14.

Figure 11:
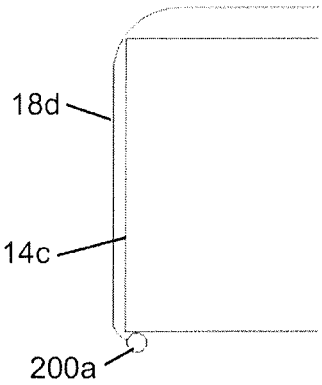

FIG. 11 depicts an alternate configuration in which housing 14*c* does not include a protrusion or a groove. Instead, cover 18*d* includes a bead 200*a*, and is sized such that bead 200*a* can extend around the bottom of housing 14*c* to coupled cover 18*d* to housing 14*c*.

Figure 12:
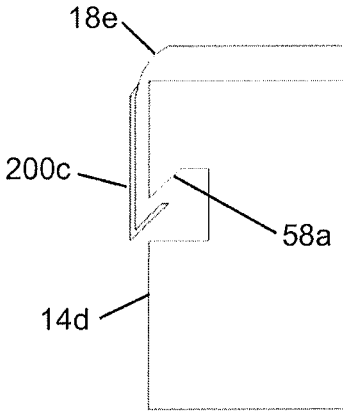

FIG. 12 depicts an alternate configuration in which groove 58*a* includes an angled upper portion, AND cover 18*e* includes a peripheral bead 200*c* that is hooked to correspond to the angled upper portion of groove 58*a*. As shown, bead 200*c* hooks around the angled upper portion of groove 58*e* to couple cover 18*e* to housing 14*d*. As with bead 200*a*, bead 200*c* can be of unitary construction with the cover (e.g., an enlarged portion of a continuous piece of material) or can be a separate piece of material that is attached to the cover (e.g., by wrapping the cover membrane around bead 200*c*).

Figure 13:
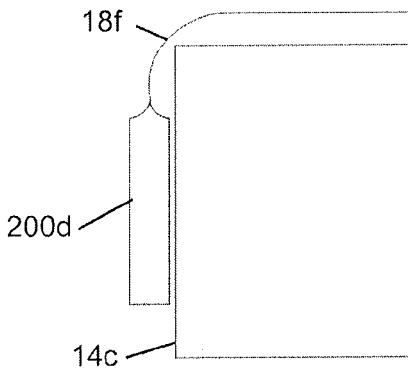

FIG. 13 depicts an alternate configuration in which cover 18*f* includes a peripheral bead 200*d* with an elongated cross-section, as shown, such that bead 200*d* frictionally engages the outer surface of sidewall 46 to couple cover 200*d* to housing 14*c*. As with bead 200*a*, bead 200*d* can be of unitary construction with the cover (e.g., an enlarged portion of a continuous piece of material) or can be a separate piece of material that is attached to the cover (e.g., by wrapping the cover membrane around bead 200*d*).

Figure 14:
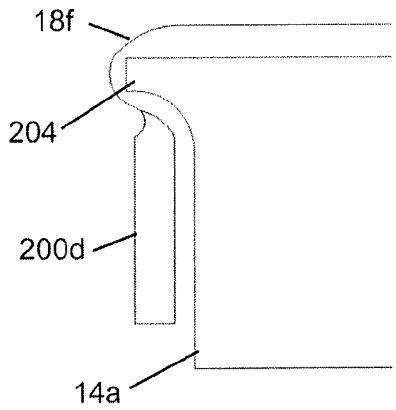

FIG. 14 depicts an alternate configuration with cover 18*f* coupled to housing 14*a*.

Figure 15:
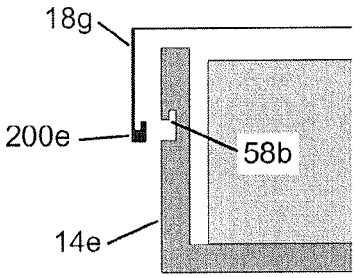

FIG. 15 depicts an alternate configuration in which groove 58*b* has a recessed upper portion, as shown, and in which cover 18*g* includes a peripheral bead 200*e* that has an upper protrusion that corresponds to the recessed upper portion of groove 58*b*, such that the upper protrusion of bead 200*e* can extend into the recessed upper portion or groove 58*e* to couple cover 18*g* to housing 14*e*. As with bead 200*a*, bead 200*e* can be of unitary construction with the cover (e.g., an enlarged portion of a continuous piece of material) or can be a separate piece of material that is attached to the cover (e.g., by wrapping the cover membrane around bead 200*e*).

Figure 16:
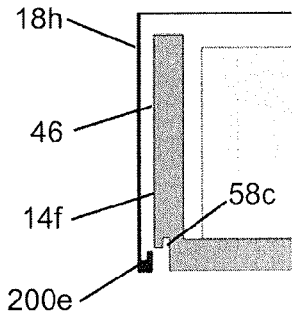

FIG. 16 depicts an alternative configuration that is substantially similar to that of FIG. 15, with the exception that groove 58*c* is disposed at a lower portion of sidewall 46.

Figure 17:
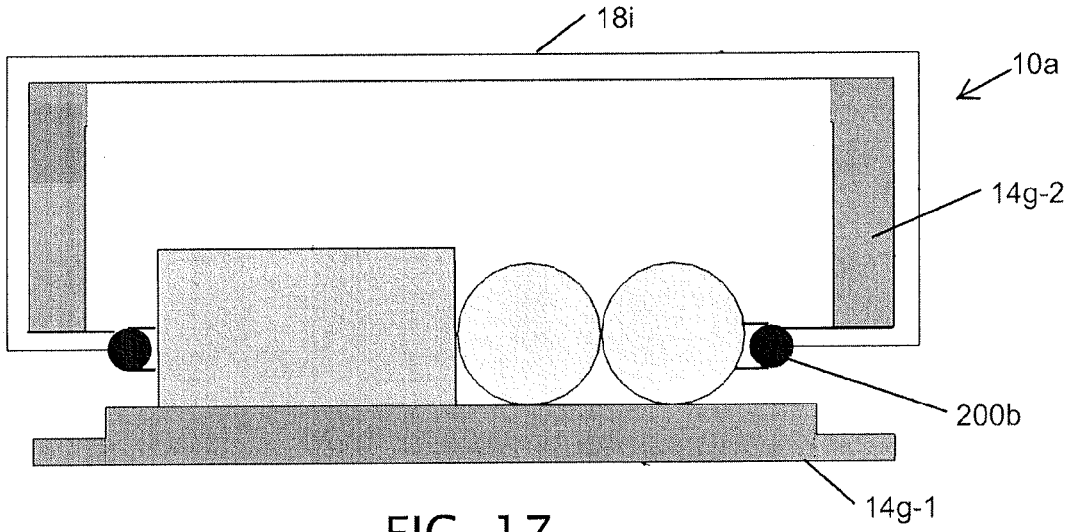
FIG. 17 depicts a side cross-sectional view of an alternate embodiment of the present apparatuses having a two-piece housing.

FIG. 17 depicts a cross-sectional view of an alternate embodiment 10*a* of the present apparatuses. Apparatus 10*a* is substantially similar to apparatus 10, with the primary exceptions that housing 14*g* includes two pieces, lower housing 14*g*-1 and upper housing 14*g*-2, and that cover 18*i* includes bead 200*b*. In the embodiment shown, cover 18*i* is configured to fit around upper housing 14*g*-2 such that when upper housing 14*g*-2 is coupled (e.g., via a press-fit and/or fasteners such as screws or the like) to lower housing 14*g*-1, bead 200*b* is inside upper housing 14*g*-2 and cover 18*i* extends between lower and upper housings 14*g*-1 and 14*g*-2, respectively. In other embodiments, bead 200*b* may be omitted.

Figure 18:
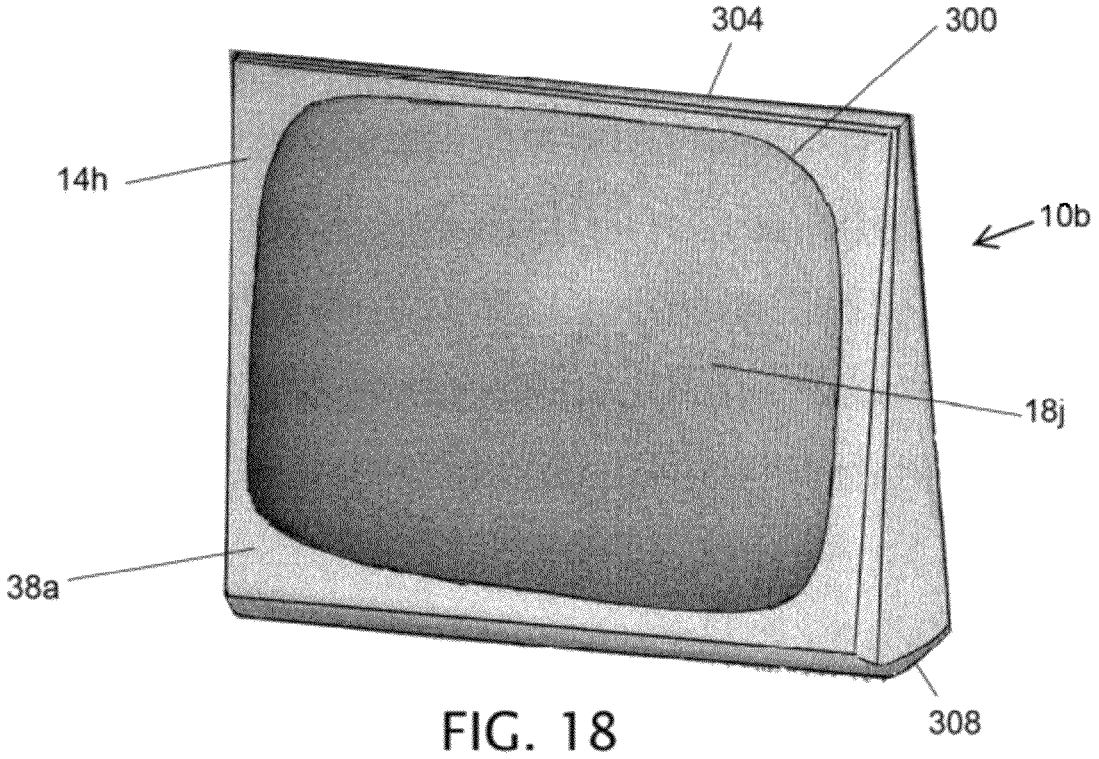
FIG. 18 depicts a perspective view of another alternate embodiment of the present apparatuses.

FIG. 18 depicts a perspective view of another alternate embodiment 10*b* of the present apparatuses. Apparatus 10*b* is substantially similar to apparatuses 10 and 10*a*, with the primary exceptions that housing 14*h* is wedge shaped, and that cover 18*j* is coupled to an interior portion of the housing such that the outer perimeter of the flexible portion of the expandable chamber is defined in at least some configurations (such as the one shown in FIG. 18) is defined by a perimeter 300 of an opening through the housing (and such that cover 18*j* covers opening defined by perimeter 300). Cover 18*j* can be coupled to housing 14*h* by any suitable means (e.g., adhesive, glue, staples, rivets, retaining ring, and/or the like). The wedge shape of housing 14*h* is at least partially defined by an upper side 304, a lower side 308 that is deeper than upper side 304, and second or front side 38*a* is angled between the relatively shallower upper side and the relatively deeper or thicker lower side. As shown in FIG. 18, the opening through which cover 18*j* extends can be defined in front side 38*a* of the housing.

Figure 19:
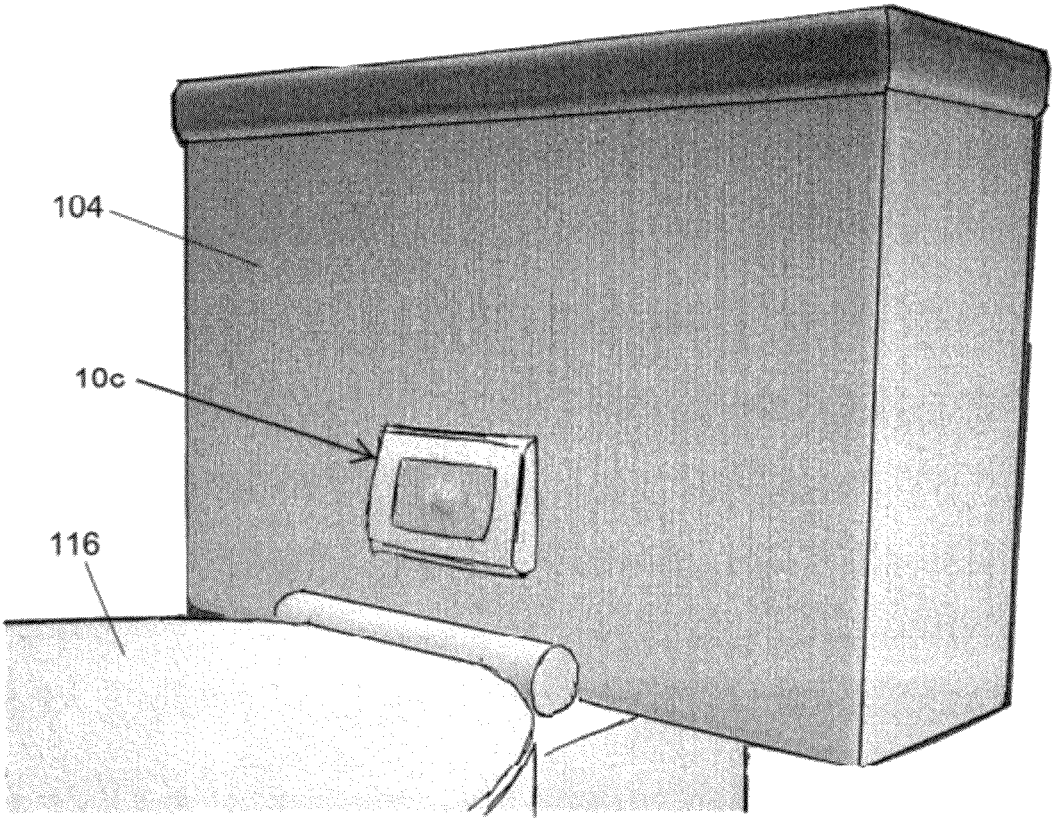
FIGS. 19-21 depict perspective views of another alternate embodiment of the present apparatuses, shown coupled to a toilet.
Figure 20:
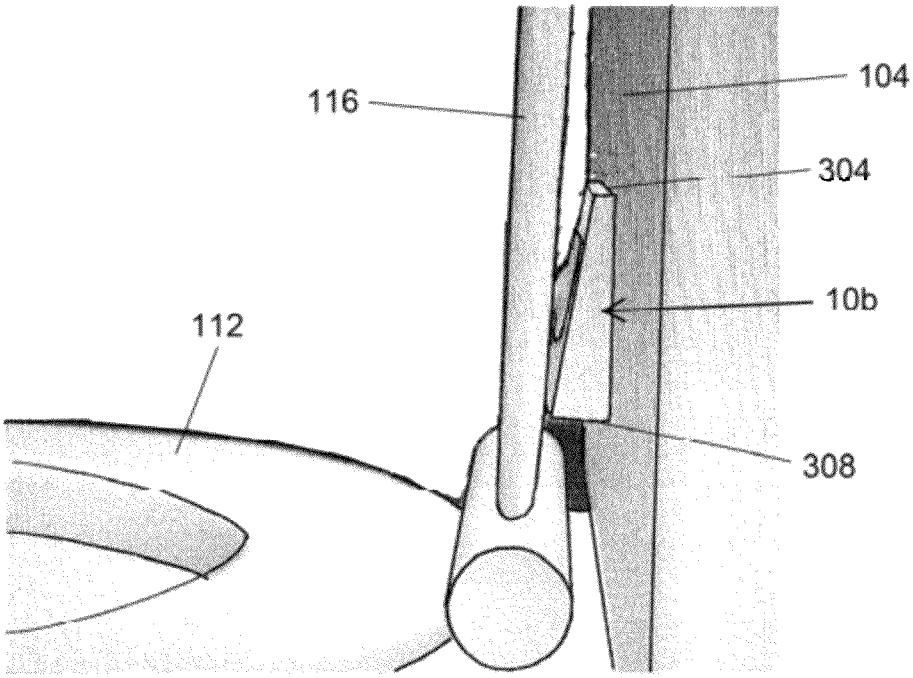
Figure 21:
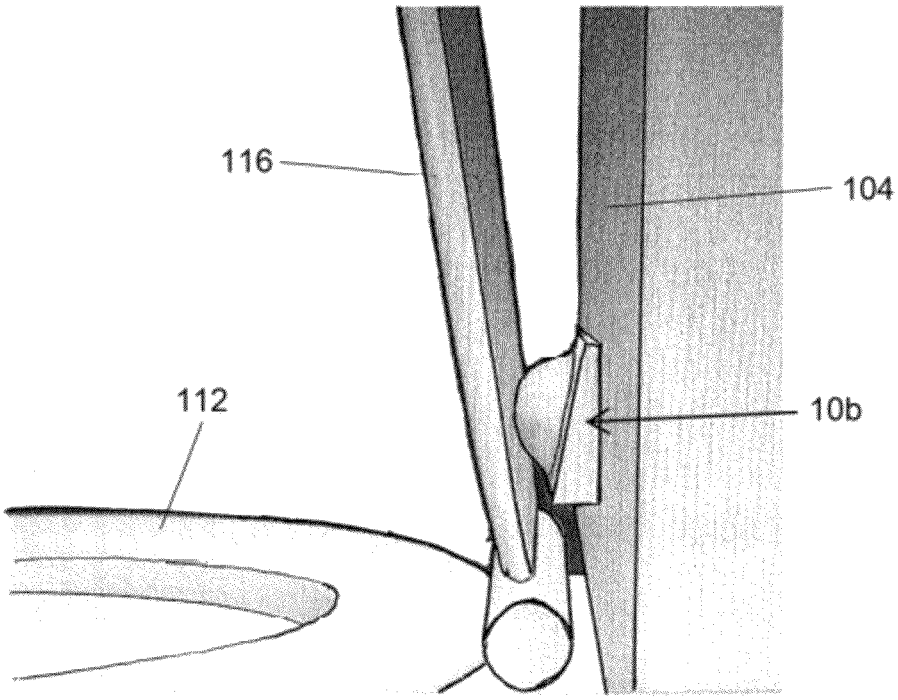

FIGS. 19-21 depict perspective views of another alternate embodiment 10*c* of the present apparatuses, shown coupled to a toilet. Apparatus 10*c* is substantially similar to apparatus 10*b*, with the primary exception that opening 300*a* of apparatus 10*c* is slightly different in shape and size than opening 300 of apparatus 10*b*. As shown, apparatus 10*c* (or 10*b*) can be coupled to a lower portion of toilet tank 104, such that lower side 308 is closer to the toilet bowl 108 than upper side 304. As shown in from FIG. 20 to FIG. 21, in use the embodiment shown, as the expandable chamber inflates, cover 18*j* projects outwardly to contact and eventually tip toilet lid 116 and/or toilet seat 112 away from toilet tank 104 to close toilet lid 116 relative to toilet bowl 108.

The various illustrative embodiments of the present devices and kits are not intended to be limited to the particular forms disclosed. Rather, they include all modifications and alternatives falling within the scope of the claims. For example, embodiments other than the one shown may include some or all of the features of the depicted embodiment.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. An apparatus comprising:

a housing;

a cover configured to be coupled to the housing such that the housing and cover cooperate to define an expandable chamber;

an electric pump coupled to the housing such that when the cover is coupled to the housing the pump is disposed in the chamber, and the pump is configured to pump air into the chamber to expand the volume of the chamber;

a sensor coupled to the housing; and a controller coupled to the housing and configured to activate the pump if the sensor detects an event.

2. The apparatus of claim 1, where the controller is configured to activate the pump after a delay if the sensor detects an event.

3. The apparatus of claim 1, where the controller is configured to deactivate the pump if the sensor detects a second event.

4. The apparatus of claim 1, where the sensor comprises one or more sensors selected from the group consisting of: vibration sensors, sound sensors, motion sensors, infrared sensors, beam-trip sensors, sonar sensors, proximity sensors, and light sensors.

5. An apparatus comprising:

a housing;

a cover configured to be coupled to the housing such that the housing and cover cooperate to define an expandable chamber;

a pump coupled to the housing such that when the cover is coupled to the housing the pump is disposed in the chamber, and the pump is configured to pump air into the chamber to expand the volume of the chamber;

a sensor; and a controller configured to activate the pump if the sensor detects an event;

where when the cover is coupled to the housing the controller is disposed in the chamber.

6. An apparatus comprising:

a housing;

a cover configured to be coupled to the housing such that the housing and cover cooperate to define an expandable chamber; and a pump configured to pump air into the chamber to expand the volume of the chamber;

a sensor coupled to the housing; and a controller configured activate the pump if the sensor detects vibrations;

where the pump, sensor, and controller are configured to be coupled to a power source.

7. The apparatus of claim 6, where the sensor is coupled to the housing such that when the cover is coupled to the housing the sensor is disposed in the chamber.

8. The apparatus of claim 6, where the pump is coupled to the housing such that when the cover is coupled to the housing the pump is disposed in the chamber.

9. The apparatus of claim 6, where the controller is configured to activate the pump after a delay if the sensor detects an event.

10. The apparatus of claim 6, where the controller is configured to deactivate the pump if the sensor detects a second event.

11. The apparatus of claim 6, where the sensor comprises one or more sensors selected from the group consisting of: vibration sensors, sound sensors, motion sensors, infrared sensors, beam-trip sensors, sonar sensors, proximity sensors, and light sensors.

12. The apparatus of claim 6, where the cover comprises an elastic material.

13. The apparatus of claim 6, where the cover is removably coupled to the housing.

14. The apparatus of claim 6, further comprising:

a valve configured to be actuated to decrease the amount of air in the chamber.

15. The apparatus of claim 14, where the apparatus is configured such that if the volume of the chamber is expanded relative to a minimum chamber volume, decreasing the amount of air in the chamber will decrease the volume of the chamber.

16. The apparatus of claim 14, where the valve is coupled to the controller and is configured such that the controller can actuate the valve.

17. The apparatus of claim 6, where the apparatus is configured such that when the cover is coupled to the housing, water is substantially prevented from entering the chamber if (i) the pump is not activated, and (ii) the volume of the chamber is at a minimum chamber volume.

18. The apparatus of claim 6, where the housing includes a first side and a second side, the first side is configured to be coupled to a front surface of a toilet tank, and the chamber is configured to expand in a direction extending from the first side of the housing through the second side.

19. The apparatus of claim 6, further comprising:

a connector coupled to the first side of the housing.

20. A kit comprising:

an apparatus of claim 6; and one or more resilient cushions configured to be coupled to an upper surface of a toilet bowl or a lower surface of a toilet seat of a toilet having a toilet seat such that if the toilet seat is in a lowered position, the one or more resilient cushions are disposed between the toilet seat and the upper surface of the toilet bowl.

* * * * *